US008568206B2

(12) United States Patent
Ramanath et al.

(10) Patent No.: US 8,568,206 B2
(45) Date of Patent: Oct. 29, 2013

(54) ABRASIVE ARTICLE FOR USE WITH A GRINDING WHEEL

(75) Inventors: Srinivasan Ramanath, Holden, MA (US); Ramanjam Vedantham, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 321 days.

(21) Appl. No.: 12/966,804

(22) Filed: Dec. 13, 2010

(65) Prior Publication Data

US 2011/0143641 A1 Jun. 16, 2011

Related U.S. Application Data

(60) Provisional application No. 61/285,744, filed on Dec. 11, 2009.

(51) Int. Cl.
*B24D 18/00* (2006.01)

(52) U.S. Cl.
USPC ..... 451/548; 451/541; 451/544; 451/546; 125/22; 125/15

(58) Field of Classification Search
USPC ..... 451/541, 544, 546, 547, 548, 550, 551, 451/549; 125/22, 15
See application file for complete search history.

(56) References Cited

U.S. PATENT DOCUMENTS

| | | | | | |
|---|---|---|---|---|---|
| 797,427 | A | * | 8/1905 | Buckner | 451/551 |
| 875,935 | A | * | 1/1908 | Landis | 451/547 |
| 1,714,754 | A | * | 5/1929 | Ballash | 451/548 |
| 1,868,492 | A | * | 7/1932 | Bucheister | 451/548 |
| 1,963,823 | A | * | 6/1934 | Buckner | 451/548 |
| 3,110,579 | A | * | 11/1963 | Benson et al. | 51/293 |
| 3,353,526 | A | | 11/1967 | Daem et al. | |
| 3,494,348 | A | | 2/1970 | Lindblad | |
| 4,843,766 | A | * | 7/1989 | Umeda | 451/69 |
| 5,911,620 | A | * | 6/1999 | Spangenberg et al. | 451/548 |
| 6,033,295 | A | * | 3/2000 | Fisher et al. | 451/540 |
| 6,273,082 | B1 | * | 8/2001 | Tselesin | 125/15 |
| 6,453,899 | B1 | | 9/2002 | Tselesin | |
| 6,551,181 | B2 | * | 4/2003 | Lee | 451/548 |

(Continued)

FOREIGN PATENT DOCUMENTS

| | | | |
|---|---|---|---|
| CN | 2271946 | Y | 1/1998 |
| DE | 299 18 964 | U1 | 8/2000 |
| DE | 20 2007 016 703 | U1 | 3/2008 |
| JP | 01164564 | A | 6/1989 |

OTHER PUBLICATIONS

International Search Report for PCT/US10/60119 dated Aug. 19, 2011, 12 pgs.

*Primary Examiner* — George Nguyen
(74) *Attorney, Agent, or Firm* — Joseph P. Sullivan; Abel Law Group, LLP

(57) ABSTRACT

An abrasive article for use with a grinding wheel including an abrasive body having abrasive grains contained within a matrix of bond material, the abrasive body having a plurality of arm portions defining a twisted path having a plurality of linear portions joined by a plurality of turns.

14 Claims, 8 Drawing Sheets

(56) References Cited

U.S. PATENT DOCUMENTS

| | | | | |
|---|---|---|---|---|
| 6,712,062 | B2 * | 3/2004 | Wildenburg | 125/15 |
| 6,755,729 | B2 * | 6/2004 | Ramanath et al. | 451/541 |
| 6,890,250 | B1 * | 5/2005 | Kim et al. | 451/541 |
| 6,949,012 | B2 * | 9/2005 | Barnett, III | 451/56 |
| 2004/0110453 | A1 | 6/2004 | Barnett | |
| 2007/0254568 | A1 * | 11/2007 | Park | 451/548 |
| 2008/0287049 | A1 * | 11/2008 | Salzgeber et al. | 451/548 |
| 2009/0305619 | A1 | 12/2009 | Schmied | |

* cited by examiner

ABRASIVE ARTICLE FOR USE WITH A GRINDING WHEEL

CROSS-REFERENCE TO RELATED APPLICATION(S)

The present application claims priority from U.S. Provisional Patent Application No. 61/285,744, filed Dec. 11, 2009, entitled "Abrasive Article For Use With a Grinding Wheel," naming inventors Srinivasan Ramanath and Ramanjam Vedantham, which application is incorporated by reference herein in its entirety.

BACKGROUND

1. Field of the Disclosure

The following is directed to abrasive article for use with grinding wheels, and particularly abrasive segments for use with segmented grinding wheels.

2. Description of the Related Art

Bonded abrasive tools consist of rigid, and typically monolithic, three-dimensional, abrasive composites in the form of wheels, discs, segments, mounted points, hones and other tool shapes, having a central hole or other means for mounting onto a particular type of grinding, polishing or sharpening apparatus or machine. Bonded abrasive tools are generally composites having three structural elements or phases: abrasive grain, bond, and porosity. Such tools are manufactured in a variety of "grades" and "structures" that have been defined according to practice in the art by the relative hardness and density of the abrasive composite (grade) and by the volume percentage of abrasive grain, bond and porosity within the composite (structure). Various types of abrasive grain materials can be combined with various types of bond materials. For example, use of superabrasive grains (e.g., diamond or cubic boron nitride (CBN)) or alumina abrasive grains are common in abrasive tools. The bond material can be an organic material, such as a resin. Certain other bond materials include inorganic materials, including for example compositions forming a vitreous material, or alternatively, a metal material.

Abrasive (i.e., grinding) wheels are widely used on conventional grinding machines and on hand-held angle grinders. When used on these machines the wheel is held by its center and is rotated at a relatively high speed while pressed against the workpiece. The abrasive surface of the grinding wheel wears down the surface of the work by the collective cutting action of abrasive grains of the grinding wheel. Grinding wheels are used in both rough grinding and precision grinding operations. Rough grinding is used to accomplish rapid stock removal without particular concern for surface finish and burn. Precision grinding is concerned with controlling the amount of stock removed to achieve desired dimensional tolerances and/or surface finish. Examples of precision grinding include the removal of precise amounts of material, sharpening, shaping, and general surface finishing operations such as polishing, and blending (i.e., smoothing out weld beads).

Conventional face grinding wheels or surface grinding wheels, in which the generally planar face of the grinding wheel is applied to the workpiece, may be used for both rough and precision grinding, using a conventional surface grinder or an angle grinder with a planar face. Various wheel shapes as designated by ANSI (American National Standards Institute) are commonly used in grinding operations. These wheel types include cylinder wheels (Type 2), abrasive discs (wheels having flat, annular grinding faces), straight cup wheels (Type 6), flaring cup (Type 11), dish wheels (Type 12), and depressed center wheels (Types 27 and 28).

Still, various industries continue to demand improved grinding wheels, especially the electronics industry, in a continuing effort to find efficient methods to prepare and finish sensitive workpieces, such as wafers.

SUMMARY

According to one aspect, an abrasive article includes an abrasive body having abrasive grains contained within a bond material, wherein the abrasive body is formed of a plurality of leading edges spaced apart from each other along a null axis of the abrasive body, wherein a leading edge is defined by a series of leading points, each of the leading points having an outward normal vector having a positive vector component with regard to a directional vector defining a direction of rotation at the leading point. The abrasive body further includes a plurality of trailing edges spaced apart from each other along the null axis of the abrasive body, wherein a trailing edge is defined by a series of trailing points, each of the trailing points having an outward normal vector having a negative vector component with regard to a directional vector defining a direction of rotation at the trailing point. The abrasive body further includes a plurality of neutral edges, wherein a neutral edge is defined by a series of neutral points, each of the neutral points having an outward neutral normal vector perpendicular to the directional vector at that neutral point. Additionally, the abrasive body can be formed such that is comprises an edge ratio of at least about 0.5, wherein the edge ratio is defined by the equation [(Lle+Lte)/(Lle+Lte+Lne)], wherein Lle is the total length of the plurality of leading edges, Lte is the total length of the plurality of trailing edges, and Lne is the total length of the plurality of neutral edges.

According to another aspect, an abrasive article includes an abrasive segment having an abrasive body formed of a plurality of arm portions including abrasive grains contained within a bond material, the abrasive segment further including cavities disposed between each of the arm portions of the plurality of arm portions, and wherein each arm portion of the plurality of arm portions comprises a leading edge and a trailing edge, wherein the leading edge is defined by a series of leading points, each of the leading points having an outward normal vector having a positive vector component with regard to a directional vector defining a direction of rotation at the leading point. The abrasive body is formed wherein the trailing edge is defined by a series of trailing points, each of the trailing points having an outward normal vector having a negative vector component with regard to the directional vector at the trailing point, and further wherein each arm portion has a cutting distance measured along an arc sector defining the direction of rotation between a leading point on the leading edge and a trailing point on the trailing edge, wherein the cutting distance is not greater than about 1000 Gs for a Gs between about 1 micron and about 500 microns, wherein Gs is the average grit size of the abrasive grains.

In yet another aspect, an abrasive article for use with a grinding wheel includes an abrasive segment having an abrasive body formed of a plurality of arm portions, wherein the abrasive body includes abrasive grains contained within a matrix of bond material, the abrasive segment further comprising cavities defined as open regions between the arm portions. Additionally, the abrasive body is formed such that the abrasive segment has an abrasive body volume ($V_{AB}$) and wherein the plurality of cavities have a cavity volume ($V_C$), the abrasive segment having a cavity volume percentage defined as $[V_C/(V_{AB}+V_C)]$ of at least about 20%.

In still another aspect, an abrasive article for use with a grinding wheel includes an abrasive body comprising abrasive grains contained within a matrix of bond material, the abrasive body having a plurality of arm portions defining a twisted path having a plurality of linear portions joined by a plurality of turns.

According to another aspect, an abrasive article includes a first abrasive segment affixed to a base, the first abrasive segment including an abrasive body having abrasive grains contained within a bond material, and a null axis extending along the length of the abrasive body and bisecting the width of the abrasive body. The abrasive body has a first leading edge intersecting the null axis at a first position and a second leading edge intersecting the null axis at a second position, the first and second positions spaced apart from each other and separated by a cavity.

In another aspect, an abrasive article includes a base having a surface and a first abrasive segment affixed to the surface of the base, the abrasive segment having abrasive grains contained within a bond material, the abrasive segment having a plurality of arm portions defining a twisted path having a plurality of linear portions joined by a plurality of turns.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following relates to bonded abrasive articles or tools, such as grinding wheels, grinding segments, grinding discs and hones, having certain compositional structures, methods of manufacturing such tools so as to create particular tool structures, and to methods of grinding, polishing or surface finishing using such tools. In particular, the description is directed to abrasive articles, particularly abrasive segments, for use with grinding wheels for finishing of surfaces. The abrasive articles herein incorporate abrasive segments having particular designs, which may facilitate improved grinding performance of the abrasive article and improved post-finishing properties of the workpiece. Notably, the abrasive articles described herein may be particularly suited in finishing of sensitive materials such as wafers used in the electronics industry, which can be made of materials such as silicon carbide, silicon, and sapphire.

Figure 1:
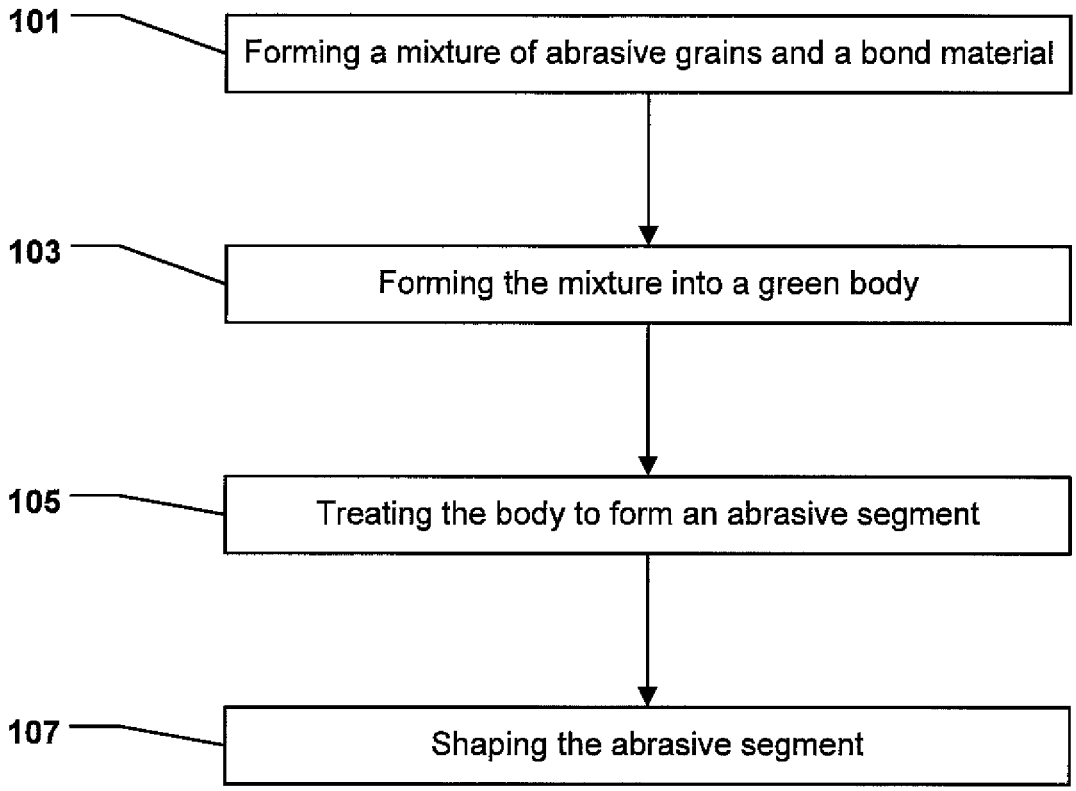
FIG. 1 includes a flow chart illustrating a method of forming an abrasive article in accordance with an embodiment.

FIG. 1 includes a process flow for forming an abrasive article in accordance with an embodiment. In particular, FIG. 1 includes a process for forming an abrasive segment having a particular design in accordance with embodiments herein. The process can be initiated at step 101 by forming a mixture of abrasive grains in a bond material. The abrasive grains can include inorganic materials, such as oxides, carbides, borides, nitrides, and a combination thereof. In certain instances, the abrasive grains can include materials such as alumina, silica carbide, silica, ceria, and a combination thereof. In fact, for certain abrasive articles, the abrasive grains may consist essentially of alumina. Still, in other instances the abrasive grains can include a superabrasive material. Suitable superabrasive materials can include diamond, cubic boron nitride, and a combination thereof. Certain mixtures may be formed with abrasive grains selected primarily from diamond, such that the final-formed abrasive article includes abrasive grains consisting essentially of diamond.

In other instances, the abrasive grains can have a coating. That is, the abrasive grains may have a layer of material overlying the exterior surfaces. In such instances, the coating can be an inorganic material. Suitable inorganic materials can include metals, oxides, borides, nitrides, carbides, and a combination thereof. In particular instances, the coating can include a metal or metal alloy material, including transition metal elements such as copper, nickel, titanium, silicon, chromium, and a combination thereof.

It will be appreciated that different types of abrasive grains can be used in combination. For example, a suitable combination of abrasive grains may include alumina abrasive grains combined with diamond abrasive grains. Various percentages of the abrasive grains can be used to form the mixture, including for example, using diamond abrasive grains in a majority amount (i.e., greater than 50%) and secondary abrasive grains (e.g., alumina) in a minority amount (i.e., less than 50%).

The abrasive grains can have an average grit size suitable for the intended application of the abrasive article. For example, the abrasive grains can have an average grit size that is generally less than about 500 microns, such as less than 250 microns, or even less than about 100 microns. In particular instances, the abrasive grains can have an average grit size within a range between about 0.01 microns and about 200 microns, such as between about 0.1 microns and about 150 microns.

The bond material used in forming the mixture can include an inorganic material or organic material. For example, the bond material can include an organic material that may function as the primary bonding component. Such organic materials may include natural organic materials, synthetic organic materials, and a combination thereof. In particular instances, the organic material can be made of a resin, which may include thermosets, thermoplastics, and a combination thereof. For example, some suitable resins can include phenolics, epoxies, polyesters, cyanate esters, shellacs, polyurethanes, rubber, polyimides and a combination thereof.

In other instances, the mixture may be formed of a bond material of an inorganic material. Suitable inorganic materials can include metals, glass, glass-ceramics, and a combination thereof. For example, particularly useful metals can include transition metal species, which may form brazeable materials. Transition metal species can include, but are not limited to, vanadium, chromium, manganese, iron, cobalt, nickel, copper, zinc, tin, zirconium, silver, molybdenum, tantalum, tungsten, and a combination thereof.

Other embodiments may use a bond material made of a composite material, including for example, a combination of organic and inorganic materials. For example, the bond material can include a combination of a metal material combined with a resin material. In more particular instances, the bond material can include a metal alloy (e.g., a copper/tin metal material) that is combined with a resin.

Still, it will be appreciated that the bond material can be formed of a glass material. In such instances, the bond material may include a certain content of fritted material, a powder material formed from a glass material that facilitates formation of a vitreous bond material when thermally treated. Suitable glass and/or glass-ceramic materials can include oxides. Some suitable oxides may include silica, alumina, boride, alkali oxide compounds (i.e., oxide compounds and complexes incorporating Group IA elements from the Periodic Table), and alkaline earth oxide compounds (i.e., oxide compounds and complexes incorporating Group IIA elements from the Periodic Table).

In addition to the incorporation of abrasive grains and bond materials to form a mixture, it will be appreciated that other additives may be included within the mixture to facilitate proper formation of the final abrasive article. Examples of such additives can include stabilizers, binders, surfactants, pore formers, and the like. Suitable pore formers can include, but are not limited to, hollow glass beads, ground walnut shells, beads of plastic material or organic compounds, foamed glass particles and bubble alumina, elongated grains, fibers and combinations thereof.

After forming the mixture including abrasive grains and bond material, the process can continue at step 103 by forming the mixture into a green body. It will be appreciated that a green body is an unfinished article, for example an unsintered body in the case of an abrasive article utilizing an inorganic bond material. Various forming methods can be used including molding, casting, pressing (hot pressing or cold pressing), and a combination thereof. In particular instances, the forming process can include the formation of a green body having a general polygonal shape (e.g., rectangular, cylindrical, etc.), which can be referred to as a blank. The blank can have a general shape that is lacking the design features of the final-formed abrasive article. That is, later processing will be undertaken to shape the blank into the desired final-form of the abrasive article.

After forming the mixture into a green body at step 103, the process can continue at step 105 by treating the body to form an abrasive segment. The process of treating can include a heating process, which can vary depending upon the selected bond material. For example, in the context of an abrasive article utilizing an organic bond material, the heating process can be conducted at temperatures less than about 600° C., such as less than 500° C., and particular within a range between 200° C. and about 500° C. Such a process may be utilized to drive off volatiles and set the bond material to form the final abrasive article.

For bond materials utilizing a metal material, including for example a combination of copper and tin, the heating process may utilize temperatures of at least about 300° C., such as at least about 400° C., at least about 500° C., or even at least about 600° C. Particular forming processes may utilize a heating temperature within a range between about 300° C. and about 1000° C. depending upon the combination of elements within the metal bond materials. In other instances, the treating temperature can be within a range between about 300° C. and about 900° C. between about 300° C. and about 800° C. between about 400° C. and about 650° C., or even between about 500° C. and about 650° C.

In certain instances, for abrasive articles utilizing a metal bond material, the forming process may combine the shaping and heating processes. For example, a cold-pressing/sintering operation can be conducted on the green material to shape and densify the green article. Cold-pressing/sintering operations may also reduce finishing processes, since the final-formed piece can have finished contours.

In other embodiments, the bond material may include an inorganic material, particularly glass and/or glass-ceramic materials. In such instances, higher treating temperatures may be used as compared to abrasive articles utilizing an organic bond material. That is, the treatment temperature may be suitable for conducting a brazing operation in the context of a bond material comprising a metal. In the context of a bond material using a glass or glass-ceramic material, the green body may be treated at temperatures greater than 800° C., such as greater than 900° C., and particularly within a range between 1000° C. and about 1500° C. for densification (e.g., sintering) of the bond material.

Certain embodiments can utilize a combination of inorganic and organic materials in the bond material, which may be referred to as a hybrid matrix material. For example, some bond materials may utilize a combination of a metal and polymer material. In such embodiments, the inorganic material may be present in a greater amount, as measured by volume percent, such that the bond contains greater than 50 vol % inorganic material, and a minor amount of organic material (i.e., less than about 50 vol % polymer).

After treating the green body to form an abrasive article in step 105, the process can continue at step 107 by shaping the abrasive article. In particular, the process of shaping can give the abrasive article certain design features described in embodiments herein. That is, the treated blank may be shaped such that it has certain shapes and surfaces, including but not limited to, arm portions, turns, and cavities in accordance with the designs of embodiments herein. Suitable shaping processes can include cutting, milling, and the like. One particular process can include a water-jet cutting process, wherein water with abrasives is directed at the blank at high speeds and pressures to facilitate cutting of the blank into a specified shape. In other instances, the shaping process may include an ion-beam milling process or electro-beam milling process or electro-discharge machining.

After conducting the shaping process the bonded abrasive article can be used as an abrasive segment suitable for fixation to a base material to form a fully-formed abrasive article, such as a grinding wheel. Various methods can be used to facilitate bonding between the abrasive segment and the base. For example, the abrasive segment may be affixed to the base using an adhesive, using a fastener, or even bonded (e.g. brazed) or welded to the base. As will be appreciated, a plurality of abrasive segments may be affixed to a base, such as in an ordered array or pattern to facilitate formation of the abrasive article. The segments may be bonded to the base in a manner to form a segmented bonded abrasive tool. In particular, the base can have particular regions, such as recesses designed to contain a portion of the abrasive segments and aid fixation or the abrasive segments therein.

In accordance with embodiments herein, the abrasive segment can have a density of at least 70% of theoretical density.

In other embodiments, the density of the final-formed abrasive segment may be greater, such as at least about 93%, at least 95%, at least 98%, or even at least 99% of the theoretical density.

As will be appreciated, the abrasive segments of embodiments herein can be bonded abrasive articles, having a volume of material containing abrasive grains dispersed throughout the volume of the body, which are bonded to each other via a matrix of bonding material. Accordingly, the abrasive segments are distinct from single layered cutting devices. Moreover, the abrasive segments can be formed such that the body has a particular volume of porosity contained throughout the volume of the body. The porosity may be closed pores that are generally rounded and dispersed throughout the body, open porosity which is defined by a network of interconnected channels extending throughout the body, or a combination of closed porosity and open porosity.

The body of the abrasive segment of embodiments herein can incorporate a certain content of abrasive grains, which may depend upon the type of bond material used. Still, according to certain abrasive article designs of the embodiments herein, the body of the abrasive segment can have a content of abrasive grains within a range between about 0.5 vol % and about 50 vol %, such as between about 0.5 vol % to about 38 vol %, such as between about 1.5 vol % and about 38 vol %, and particularly between about 4 vol % and about 38 vol %.

The abrasive articles of the embodiments herein can include between about 3 vol % and about 50 vol % bond material. In other instances, the abrasive article can contain between about 3 vol % to about 40 vol % bond, between about 3 vol % and about 30 vol % bond, between about 4 vol % to about 20 vol % bond, and even between about 5 vol % to about 18 vol % bond.

While a majority of the abrasive tools can have various degrees of porosity, some of the abrasive bodies formed according to embodiments contained herein may exhibit a certain content of porosity. For example, the abrasive body can have a porosity that is at least about 2 vol %. Other abrasive articles of embodiments herein can have a porosity of at least about 5 vol %, at least about 10 vol %, at least about 15 vol %, at least about 20 vol %, at least about 30 vol %, at least about 40 vol %, at least 50 vol %, or even at least about 60 vol %. Particular abrasive articles of embodiments herein can have a porosity within a range between about 0.1 vol % and about 50 vol %, between about 0.1 vol %, and about 30 vol %, between about 0.1 vol % and about 15 vol %, between about 0.1 vol % and about 5 vol %, or even between about 0.1 vol % and about 2 vol %. The porosity of the abrasive body can be primarily closed porosity of submicron pores contained within the body.

Figure 2A:
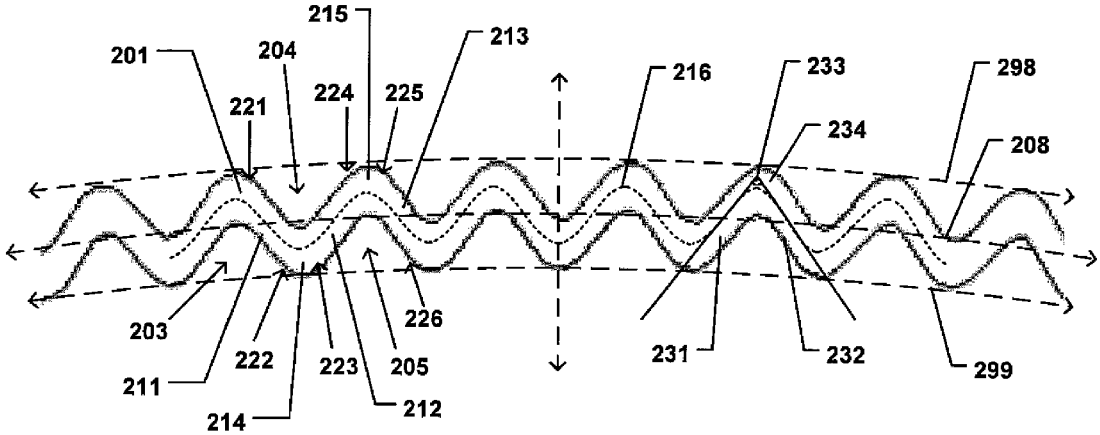
FIG. 2A includes a top view illustration of an abrasive article in accordance with an embodiment.

FIG. 2A includes a top view of an abrasive article in accordance with an embodiment. In particular, FIG. 2A includes a top view of an abrasive segment 201 in accordance with an embodiment. As illustrated, the abrasive segment 201 can have a generally arcuate shape. As illustrated in FIG. 2A, the abrasive segment 201 can define an upper arc 298 extending through uppermost points along surfaces of the abrasive segment 201 that can define a circle having a radius within a range between 25 mm and about 2 m. Likewise, opposite, lower surfaces of the abrasive segment 201 can define an arc 299 extending along the lower most points on the exterior surface of the abrasive segment 201 defining a circle having a radius within a range between 25 mm and 2 m. It will be appreciated that the abrasive segment 201 has an arcuate shape such that it can be affixed to a base having a circular shape and coincide with the circumference of the base.

As further illustrated, the abrasive segment 201 can have a null axis 208 extending through midpoints of the abrasive segment 201, midway between the arcs 298 and 299 defining the upper most and lower most points on the surface of the abrasive segment 201, respectively. As such, the null axis 208 has an arcuate shape coinciding with the arcuate shape of the arcs 298 and 299.

As illustrated, the abrasive segment 201 can include an arm portion 211, an arm portion 212, and an arm portion 213. The arm portions 211-213 can define linear regions of the abrasive segment 201 and can include ends. For example, the arm portion 211 can include a first end 221 and a second end 222, the arm portion 212 can include a first end 223 and a second end 224, and the arm portion 213 can include a first end 225 and a second end 226. It will be appreciated, as illustrated in FIG. 2A, the arm portions 211-213 can be joined to immediately adjacent arm portions using at least one of the ends, if not both end portions. For example, the arm portion 211 is joined to the arm portion 212 at the second end 222 of the arm portion 211 and the first end 223 of the arm portion 212. Likewise, arm portion 212 can be joined to the arm portion 213 at the second end 224 of the arm portion 212 and the first end 225 of the arm portion 213.

The abrasive segment 201 can be formed such that the plurality of arm portions 211-213 (including others illustrated in FIG. 2A, by not enumerated) are linked to each other in a manner such that they are linked to an immediately adjacent arm portion. In accordance with at least one embodiment, the arm portions can define a twisted path 216 having a maximum number of turns (T) defined by the equation $T=n-1$, wherein n is the number of arm portions of the entire abrasive segment 201. While different designs can be utilized, abrasive segments according to embodiments herein can utilize at least three discrete arm portions which may be linked immediately to each other. In other embodiments, the abrasive segment 201 can include a greater number of discrete arm portions.

As illustrated in FIG. 2A, the abrasive segment 201 can be formed such that it extends along a twisted path 216, which is defined by the arrangement of the arm portions 211-213 relative to each other, which are joined together by turns 214 and 215 (and others illustrated but not enumerated in FIG. 2A). For example, the arm portions 211 and 212 can be joined at respective ends by a turn 214, and the arm portions 212 and 213 are joined together at respective ends by the turn 215. As such, the twisted path 216 can include linear regions extending along the arm portions 211-213 and turning regions, wherein the twisted path changes direction between linear portions at the turns 214 and 215.

In accordance with one embodiment, the abrasive segment 201 is formed to have a twisted path 216 that can define a zig-zag pattern. In other embodiments, the twisted path, or portions of the twisted path 216, can be defined by a trigonometric function, such as a cosine or sine function. In still other embodiments, the twisted path 216, or portions of the twisted path 216, can be formed such that it can be defined by a geometric function, that is for example a parabola, logarithmic, or exponential mathematical function.

In certain embodiments, the abrasive segment 201 can be formed such that the twisted path 216 can be symmetrical around the null axis 208. Moreover, the twisted path 216 of the abrasive segment 201 can be symmetrical about a lateral axis 209. The lateral axis 209 can bisect the abrasive segment 201 through the center and into equal lengths.

As further illustrated in FIG. 2A, the abrasive segment 201 can include arm portions 231 and 232 which are immediately linked to each other at a turn 234 and define a joining angle 233 between the arm portions 231 and 232 as illustrated in FIG. 2A. According to embodiments herein, the abrasive segment 201 can be formed such that the arm portions 231 and 232 are joined at a joining angle 233 that is at least about 15°. In other embodiments, the joining angle can be greater, such as on the order of at least about 35°, such as at least about 40°, at least about 45°, at least about 50°, at least about 60°, or even at least about 80°. In particular instances, the joining angle 233 can be within a range between about 15° and about 170°, such as between about 45° and 150°, between about 45° and about 120°, between about 45° and about 90°, or even between about 60° and about 80°.

The abrasive segment 201 can further include cavities 203, 204, and 205. As illustrated, the cavities 203-205 can extend between arm portions along the twisted path 216. The cavities 203-205 can extend between arm portions, and more particularly, may be formed such that at least a portion of the cavities 203-205 intersect the null axis 208. The cavities 203-205 can provide suitable fluid flow pathways for access of fluid to the grinding zone during a grinding process.

Figure 2B:
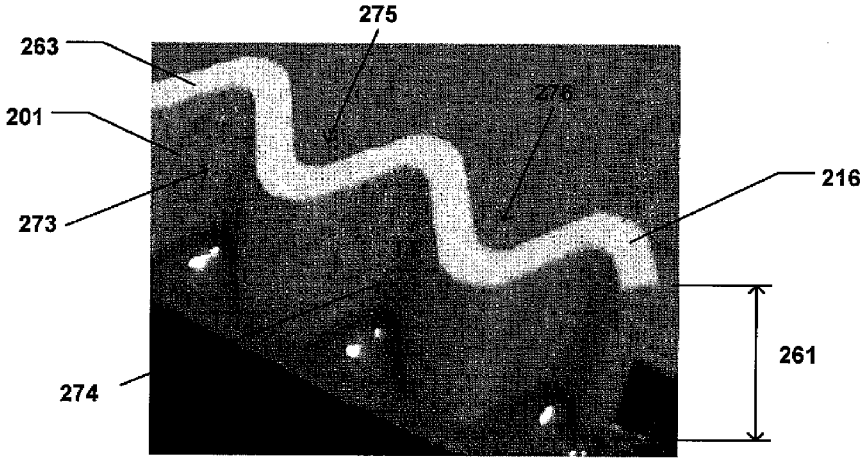
FIG. 2B includes a perspective view of a picture of the abrasive article of FIG. 2A in accordance with an embodiment.

FIG. 2B includes a perspective view of a picture of the abrasive article of FIG. 2A in accordance with an embodiment. As illustrated, the abrasive segment 201 can have a height 261, which according to particular embodiments can be within a range between about 2 mm and about 15 mm. Generally, the abrasive segment 201 has a height suitable for proper fixation with a base 291 while providing sufficient protrusion above the surface of the base 291 to affect grinding. FIG. 2B also provides a clearer illustration of cavities 273, 274, 275, and 276 as they extend along and conform to the twisted path 216, thus suitably delivering fluid to the surfaces of the abrasive segment 201 during use.

As further illustrated in FIG. 2B, the abrasive segment 201 can have an upper surface 263 configured to engage a workpiece and grind surfaces on the workpiece. The upper surface 263 of the abrasive segment 201 can be particularly flat, such that it is suitable for engaging and finishing a workpiece, particularly sensitive workpieces such as wafers. In accordance with an embodiment, the abrasive segment 201 may be formed such that the upper surface 263 has a particular surface roughness ($R_a$) that may be less than about 100 microns, less than about 10 microns, or even less than about 1 micron.

Figure 3:
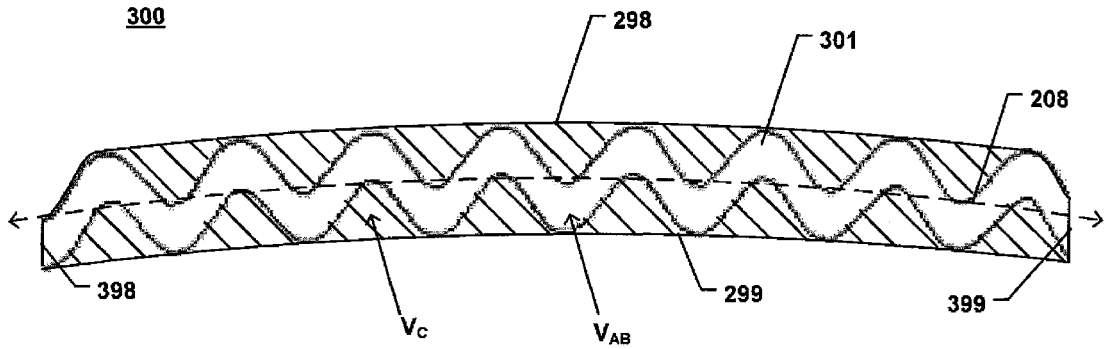
FIG. 3 includes a top view illustration of an abrasive article in accordance with an embodiment.

FIG. 3 includes a top view illustration of an abrasive article in accordance with an embodiment. In particular, the abrasive article 300 includes an abrasive segment 301 having arm portions which are linked together by turns as described in embodiments herein. In accordance with an embodiment, the abrasive segment 301 is formed such that is has a particular cavity volume ($V_C$). The abrasive segment can also be described as having a particular volume of the abrasive body ($V_{AB}$). Notably, the abrasive segment 301 can be formed such that the ratio of the volume of the abrasive body relative to the cavity volume may be particularly suited to facilitate efficient and improved grinding is achieved.

As illustrated, the cavity volume ($V_C$) can describe the volume of the cavities within the abrasive segment between the arc portions 298 and 299. The arc portions 298 and 299 as well as the outer side surface 398 and 399 of the abrasive segment define the virtual boundaries of the abrasive segment 301. That is, the volume of the abrasive segment 301 including the volume of the cavities (shown as shaded portions) and the volume of the abrasive body of the abrasive segment 301. The volume of the abrasive body ($V_{AB}$) can include the volume occupied by the abrasive grains, bond material, and any pores within the abrasive body in 3-dimensional space. Accordingly, the abrasive segment 301 can have a virtual volume, defined by the virtual boundaries noted herein, that is a sum of the cavity volume ($V_C$) and the volume of the abrasive body ($V_{AB}$).

The abrasive segment 301 can have a cavity volume percentage (CVP) defined by the equation $CVP=[V_C/(V_{AB}+V_C)]$, which is a measure of the percentage of cavity volume as compared to the virtual volume ($V_{AB}+V_C$) of the abrasive segment, of at least about 20%. Certain embodiments herein may include an abrasive segment 301 having a cavity volume percentage that is at least about 25%, such as at least 35%, at least about 45%, or even at least about 65%. Particular embodiments herein can utilize a cavity volume percentage of the abrasive segment 301 that is within a range between about 20% and 95%, such as between about 30% and 85%, or between 30% and 75%, or even between about 40% and 70%.

Furthermore, it will be appreciated that reference herein to a volume, with regard to the cavity volume or abrasive body volume will be a measurement in three dimensions. That is, the measurement of volumes herein include the areas as shown in the top view of FIG. 3 multiplied by the height of the abrasive body such that one can calculate the cavity volume or volume of the abrasive body in three space.

Figure 4:
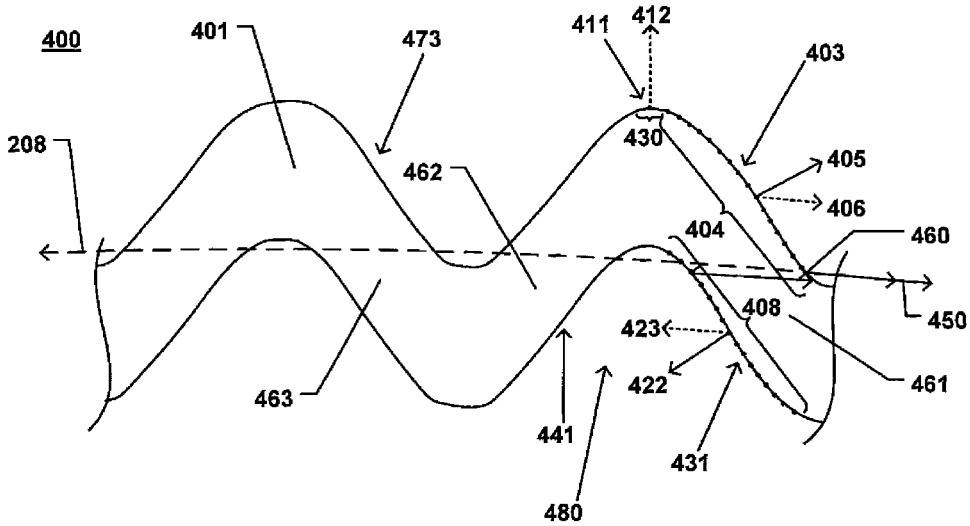
FIG. 4 includes a top view illustration of an abrasive article in accordance with an embodiment.

FIG. 4 includes a top view illustration of a portion of an abrasive article in accordance with an embodiment. In particular, FIG. 4 includes a top view of an abrasive article 400 including a portion of an abrasive segment 401 defining a twisted path having linear portions and turns in accordance with embodiments described herein. The following describes features of an abrasive segment in accordance with embodiments herein in more mathematical terms. As illustrated in FIG. 4, the abrasive segment 401 can include an arm portion 461 longitudinally spaced apart from an arm portion 462 along the null axis 208. The abrasive segment 401 further includes an arm portion 463 that is spaced apart from the arm portion 462 along the null axis 208. As further illustrated, each of the arm portions 461, 462 and 463 include leading edges 403, 441, and 473, which are longitudinally spaced apart from each other along the null axis 208.

The leading edge 403 of the arm portion 461 can be defined by a series of leading points 404 extending along an exterior surface of the abrasive body, and more particularly, along an edge at a conjunction of two surfaces at the exterior of the abrasive body. The edge may be defined by a substantially perpendicular angle between two exterior surfaces of the abrasive body. One of the exterior surfaces can be the upper surface (e.g., 263) of the abrasive body. As will be appreciated, FIG. 4 attempts to show a series of leading points at discrete positions along the length of the leading edge 403, however, from a mathematical perspective, it will be appreciated that a point is an infinitesimally small dimension and therefore the leading edge 403 can be defined by an infinite number of leading points. The leading edge 403 can be defined by the series of leading points 404, wherein each of the leading points has an outward normal vector 405 having a positive vector component 406 with regard to a directional vector 450. The directional vector 450 defines the direction of rotation at the leading points 404. That is, when the abrasive segment 401 is rotated (such as during use on grinding wheel) in a direction 450, each of the leading points 404 on the leading edge 403 are in a position to lead the cutting and/or grinding process, and thus, each of the series of leading points 404 has a positive vector component 406 of the outward normal vector 405 as compared to the direction of rotation as defined by the directional vector 450.

The arm portion 461 can also include a trailing edge 431. Generally, the trailing edge 431 is an edge that is not responsible for initiating a cutting and/or grinding action with regard to the direction of rotation 450, unlike the leading edge 403. In particular, the trailing edge 431 can be defined by a series of trailing points 408 along an exterior surface of the bonded abrasive body, and more particularly, along an edge at a conjunction of two surfaces at the exterior of the abrasive body. The trailing edge may be defined by a substantially perpendicular angle between two exterior surfaces of the abrasive body. One of the surfaces can be the upper surface of the abrasive segment 401. As illustrated, each of the trailing points 408 can have an outward normal vector 422 that includes a negative vector component 423 with regard to the directional vector 450 that defines the direction of rotation of the abrasive segment 401 during use. Notably, each of the arm portions within the abrasive segment 401 can have a leading edge and a trailing edge as defined relative to the directional vector 450.

Moreover, the abrasive segment 401 can have neutral edges. For example. a neutral edge 411 can be defined by one, or more particularly a series, of neutral points 430 along an exterior surface of the bonded abrasive body. The neutral edge 411 can be defined by a conjunction of two exterior surfaces of the abrasive body, which can be oriented at a substantially perpendicular direction relative to each other. One of the surfaces can be the upper surface. Each of the neutral points can have an outward neutral normal vector 412 that is perpendicular to the directional vector 450 defining the direction of rotation of the abrasive segment 401 during use. Notably, the neutral edges (e.g., 411) of the abrasive segment 401 can be disposed between the leading edges (e.g., 403) and trailing edges (e.g., 483).

In accordance with embodiments herein, the abrasive bodies can be formed to have an edge ratio (ER), which is defined by the equation ER=[(Lle+Lte)/(Lle+Lte+Lne)], wherein Lle is the total length of the plurality of leading edges of the body of the abrasive segment, Lte is the total length of the plurality of trailing edges of the body of the abrasive segment, and Lne is the total length of the plurality of neutral edges of the body of the abrasive segment. In accordance with embodiments herein, the abrasive bodies can be formed such that the edge ratio (ER) is at least about 0.5. In other embodiments, the edge ratio can be greater, such as at least about 0.6, at least about 0.7, at least about 0.8, or even at least about 0.9. In particular instances, the abrasive body of embodiments herein can be formed to have an edge ratio with a range between about 0.5 and 1.0, such as between about 0.6 and about 0.98, or even between about 0.7 and about 0.98.

Certain abrasive articles according to embodiment herein may be formed such that the abrasive body has a value of Lle that is substantially the same as the value of Lte. Notably, according to certain abrasive body designs herein, the abrasive body can have a value for the variable of Lle that is greater than the value of the variable Lne. In certain other instances, the body of the abrasive segment is formed such that the value for the variable of Lte is greater than the value of the variable Lne.

As further illustrated in FIG. 4, the abrasive articles herein may be formed such that each of the leading edges on each of the arm portions have a substantially linear contour. That is, the vast majority of the length of the leading edge is a linear shape, such as at least about 80%, at least about 90%, or even at least about 95% of the total length of the leading edge is linear. Moreover, each of the leading edges of the abrasive segment 401 can intersect the null axis 208.

The abrasive segment 401 can be formed such that the trailing edges of each of the arm portions can have a substantially linear contour as described above with regard to the leading edges of the abrasive segment 401. Certain embodiments may utilize leading edges and trailing edges wherein essentially all of the leading edges and essentially all of the trailing edges have a linear contour. Moreover, each of the trailing edges can intersect the null axis 208.

As further illustrated, the abrasive articles of embodiments herein may be formed such that the abrasive body is formed such that at least one trailing edge or a portion of a trailing edge is disposed between two immediately adjacent leading edges. For example, in reference to FIG. 4, the abrasive article includes a leading edge 403 and an immediately adjacent leading edge 441 of the arm portions 461 and 462 respectively. As illustrated, the trailing edge 431 is disposed in between the leading edge 403 and the leading edge 441 as traveling along the directional vector 450 defining the direction of rotation, which is parallel to the null axis 208.

As will be further appreciated, the abrasive article of embodiments herein can include an abrasive body wherein arm portions of the abrasive body can have at least one leading edge and at least one trailing edge. For example, arm portion 461 includes a leading edge 403 and a trailing edge 431. In particular, each of the arm portions of the abrasive body can define a cutting distance (CD) measured along an arc sector 460 that is parallel to the directional vector 450 and thus parallel to the direction of rotation between a leading point on the leading edge 403 and a trailing point on the trailing edge 431 of the same arm portion 461.

Embodiments herein may utilize an abrasive body wherein the arm portions have a cutting distance that is not greater than about 1000 Gs for a Gs within a range between about 1 microns and about 200 microns, wherein the notation "Gs" is the average grit size of the abrasive grains contained within the body of the abrasive segment 401. Thus the cutting distance is not greater than about 1000 times the average grit size of the abrasive grains contained within the body. This criterion has been identified as potentially facilitating efficient and/or improved grinding. Certain abrasive bodies may be formed such that the cutting distance 460 as illustrated in FIG. 4 is more particular with regard to the grit size (Gs). For example, for grit sizes within a range between about 1 microns and about 5 microns, the cutting distance can be not greater than about 1000 Gs, such as not greater than about 800 Gs, not greater than about 500 Gs, not greater than about 250 Gs, or even not greater than about 100 Gs. In particular instances, for an abrasive body utilizing an average grit size between about 1 micron and about 5 microns, the cutting distance can be within a range between about 50 Gs and about 1000 Gs, such as between about 50 Gs and about 800 Gs, between about 50 Gs and about 500 Gs, between about 50 Gs and about 250 Gs, or even between about 50 Gs about 200 Gs.

In other instances, the abrasive body may utilize an average grit size within a range between about 5 microns and about 50 microns. In such instances, the cutting distance can be not greater than about 200 Gs, such as not greater than about 150 Gs, not greater than about 100 Gs, or even not greater than about 8 Gs. In particular instances, for an abrasive body utilizing an average grit size between about 5 microns and about 50 microns, the cutting distance can be within a range between about 5 Gs and about 200 Gs, such as between about 5 Gs and about 100 Gs, or even between about 5 Gs and about 75 Gs.

In accordance with more particular embodiments, the abrasive body may utilize an average grit size within a range between about 50 microns and about 200 microns. In such instances, the cutting distance can be not greater than about 20 Gs, such as not greater than about 12 Gs, not greater than about 10 Gs, or even not greater than about 8 Gs. In certain designs, for an abrasive body utilizing an average grit size between about 50 microns and about 200 microns, the cutting distance can be within a range between about 2 Gs and about 20 Gs, such as between about 2 Gs and about 10 Gs, or even between about 2 Gs and about 8 Gs.

In still other embodiments, the abrasive body may utilize an average grit size that is greater than about 200 microns. In such instances, the cutting distance can be not greater than about 10 Gs, such as not greater than about 8 Gs, not greater than about 5 Gs, or even not greater than about 3 Gs. In particular instances, for an abrasive body utilizing an average grit size of greater than about 200 microns, the cutting distance can be within a range between about 0.5 Gs and about 10 Gs, such as between about 0.5 Gs and about 8 Gs, or even between about 0.5 Gs and about 5 Gs.

Figure 5:
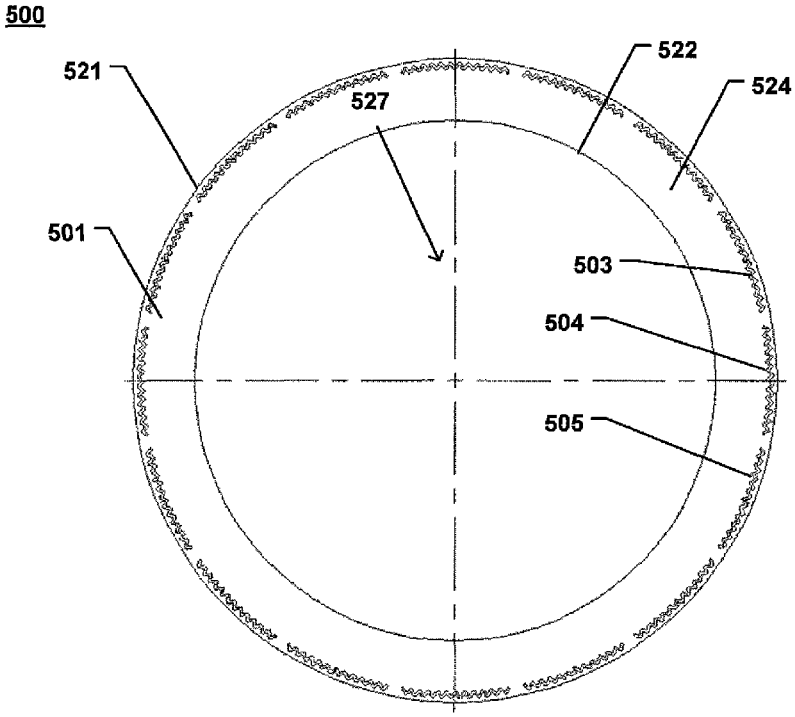
FIG. 5 includes an abrasive article including a base having abrasive segments in accordance with an embodiment.

FIG. 5 includes a top view illustration of an abrasive article in accordance with an embodiment. In particular, the abrasive article 500 can include a base 501 having a generally circular shape as viewed top down. As further illustrated, the base 501 can include an outer diameter 521 and an inner diameter 522 defining a cavity or recess 527 within the interior of the base 501. The base 501 further includes a rim region 524 between the outer diameter 521 and inner diameter 522. Notably, the abrasive article 500 can be formed such that the abrasive segments 503, 504, and 505 (and others illustrated but not enumerated) are situated on the rim region 524 of the base 501. As illustrated, the abrasive segments 503-505 can be affixed to the surface of the base 501 and circumferentially spaced apart from each other at equal intervals around the rim region 527 of the base 501.

In accordance with embodiments herein, the base 501 can be made of an inorganic material including for example a metal, metal alloy, and a combination thereof. Moreover, as will be appreciated the base 501 can have various shapes including cylindrical, cup-shaped, conical, and a combination thereof.

During grinding operations, the abrasive segments 503-505 can be placed in contact with a workpiece, such as a wafer, wherein the work surfaces of the abrasive segments 503-505 are substantially flush with a flat surface of the wafer. The base 501 can be rotated relative to the workpiece to affect material removing, and particularly a thinning of the wafer. The base 501 can be rotated alone, or alternatively, the workpiece can be rotated alone, and even in certain instances, the base 501 and the workpiece can both be rotated, such as in opposite directions or the same directions. A fluid may be applied to the workpiece and/or abrasive segments to reduce damage to the workpiece during the process.

Figure 6A:
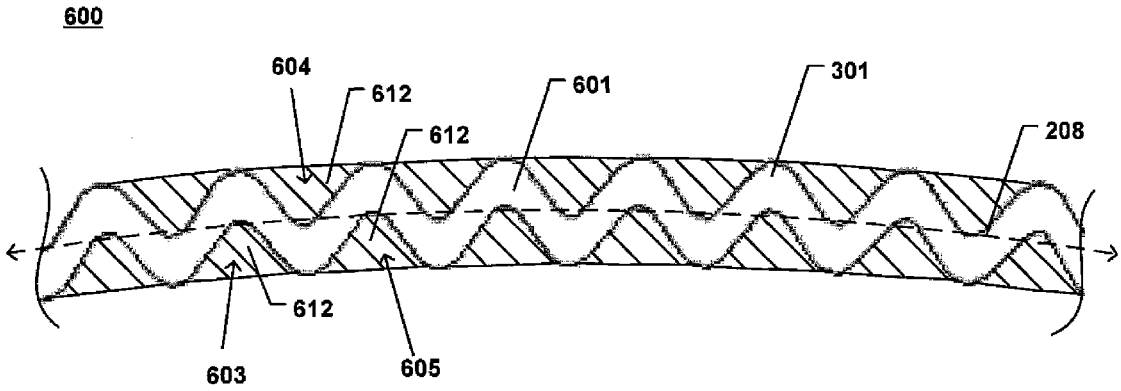
FIG. 6A includes a top view illustration of a portion of an abrasive article in accordance with an embodiment.

FIG. 6A includes a top view illustration of an abrasive article in accordance with an embodiment. In particular, FIG. 6A includes an abrasive article 600 including a body of an abrasive segment 601 for use with a grinding wheel in accordance with an embodiment. The abrasive segment 601 can include the features of abrasive segments as described in embodiments herein, including arm portions and turns defining a twisted path 216, and cavities 603, 604, and 605 extending between the arm portions and turns of the abrasive body 601. The cavities 603-605 can be spaced apart from each other along the null axis 208. More particularly, the cavities 603-605 can include a filler material 612. Notably, in certain embodiments, the cavities 603-605 can be partially filled with the filler material 612. In other embodiments, the cavities 603-605 can be substantially filled with the filler material 612 such that a majority of the volume of the cavities includes the filler material 612.

In accordance with an embodiment, the filler material 612 can include inorganic materials, organic materials, and a combination thereof. In particular instances, the filler material 612 includes an organic material, such as a synthetic material, including by not limited to a polymer, such as thermoplastics, thermosets, and a combination thereof. Some particularly suitable polymer materials can include elastomers, such as rubber, styrenes, silicones, fluorelastomers, and a combination thereof. Such filler material 612 can facilitate maintaining the proper design of the abrasive body 601 during use and may facilitate the mechanical integrity of the abrasive body 601 and reducing damage to the abrasive body 601 by shocks during use.

Inorganic materials can be included in the filler material 612, and particularly as filling material within the organic material. For example, in particular embodiments, the filler material 612 can be made primarily of an organic material that includes particles of inorganic material. The particles of inorganic material can be abrasive particulate, including those materials noted herein for use as abrasive grains.

Figure 6B:
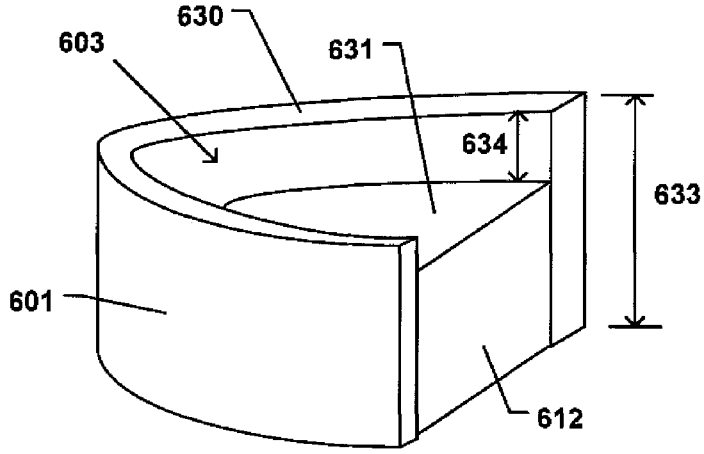
FIG. 6B includes a perspective view illustration of the abrasive article of FIG. 6A in accordance with an embodiment.

FIG. 6B includes a perspective view illustration of a portion of the abrasive article of FIG. 6A. As illustrated, the filler material 612 can have an upper surface 631 which is recessed from (i.e., below) the upper surface 630 of the abrasive body 601. As illustrated, the upper surface 631 of the filler material 612 can be recessed from the upper surface 630 by a distance 634. The distance 634 can be a fraction of the total height 633 of the abrasive body 601. In particular, the distance 634 can be not greater than about 95% of the height 633. In other instances, the distance 634 can be not greater than about 80%, such as not greater than about 75%, not greater than about 60%, not greater than about 50%, not greater than about 40%, not greater than about 30%, not greater than about 20%. Still, the distance 634 can be within a range between about 5% and about 75%, between about 10% and about 60%, or even between about 20% and 50% of the height 633.

Figure 7A:
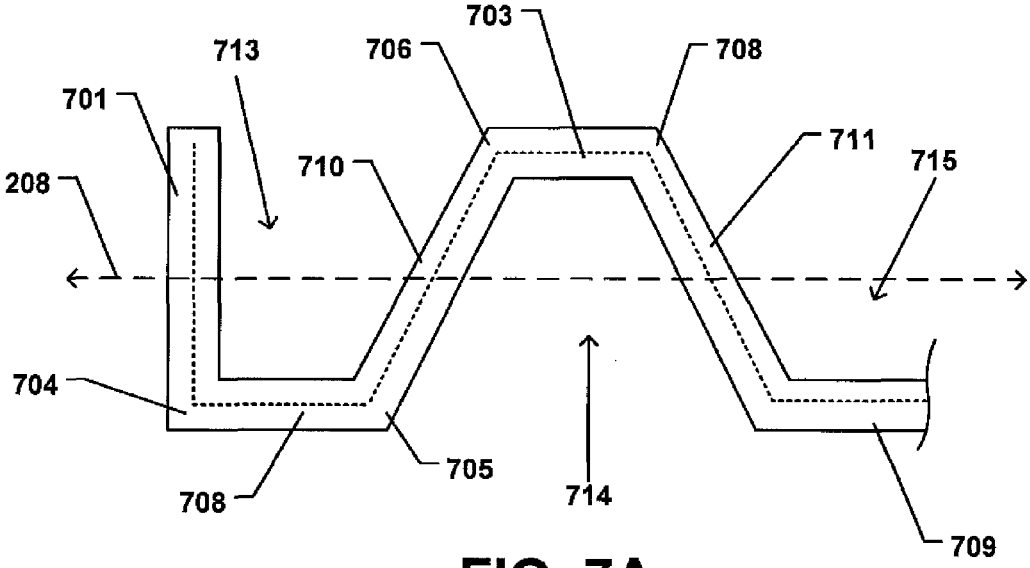
FIGS. 7A-7E include additional designs of abrasive articles in accordance with embodiments.
Figure 7B:
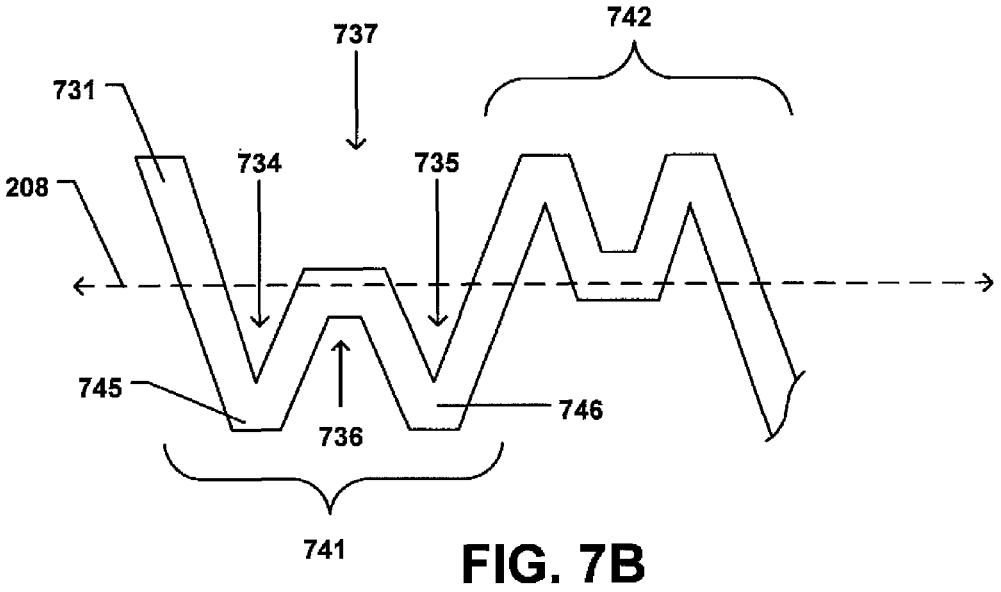
Figure 7C:
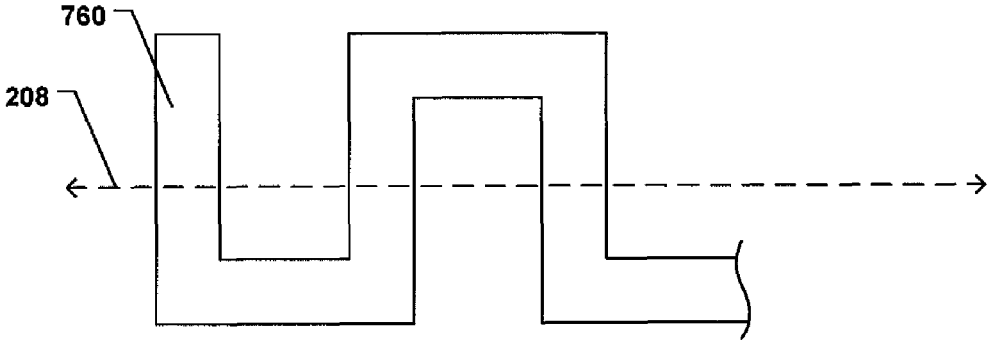

FIG. 7A through 7C include alternative designs for abrasive articles, particularly abrasive segments for use with an abrasive article in accordance with embodiments herein. FIG. 7A includes an illustration of an abrasive segment 701 including arm portions and turns defining a twisted path 703 that utilizes a combination of right angle turns 704 and obtuse joining angle turns 705 and 706. The obtuse joining angles of the turns 705 and 706 are facilitated by the extension of arm portions 707, 708, and 709 in direction parallel to the null axis 208 at certain lengths, and which are joined by the arm portions 710 and 711, which are angled relative to the null axis 208. As such the cavities 713, 714, and 715 present between the arm portions 707-711 can be larger than those of previous embodiments described herein.

FIG. 7B includes an illustration of an abrasive segment 731 including arm portions and turns and defining a twisted path that utilizes a combination of acute angle joining angle turns 745 and 746. More particularly, the design of the abrasive segment 731 includes minor cavities 734 and 735 contained within a major cavity 737, which may improve fluid flow during grinding. The abrasive segment 731 includes a series of arm portions joined in the shape of "W"s 741, 742 that are joined to each other to define the twisted path.

Notably, the abrasive segment of FIG. 7C utilizes generally the same structure as the abrasive segment of FIG. 7A, with the exception that each of the arm portions extend at one of two angles relative to the null axis 208; either generally parallel to the null axis 208, or perpendicular to the null axis 208.

Figure 7D:
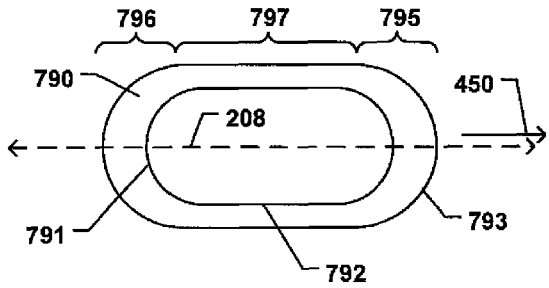

FIG. 7D includes an alternative shape for an abrasive segment according to embodiments herein. As illustrated the abrasive segment 790 can have a rounded shape. In particular, the abrasive segment 790 can have an outer surface 793 defining the general rounded contour of the article. The abrasive segment 790 can have a central opening 791 defined by an inner surface 792 having a contour complementary to the outer surface 793, such that the central opening 791 has the same contour of the outer surface 793. In particular, the outer surface 793 can act as a leading edge for the front portion 795 of the abrasive segment 790 assuming a direction of rotation along the directional vector 450. The same outer surface 793 can be a trailing edge at a rear portion 796 of the abrasive segment 790, and a neutral edge at a middle portion 797 of the abrasive segment 790 with regard to the direction vector 450. More particularly, the inner surface 792 can act as a trailing edge within the front portion 795, a leading edge within the rear portion 796, and a neutral edge within the middle portion 797 during use of the abrasive segment 790 along the directional vector 450. Like other embodiments herein, a significant portion of the abrasive segment 790 is comprised of leading edges and trailing edges.

Figure 7E:
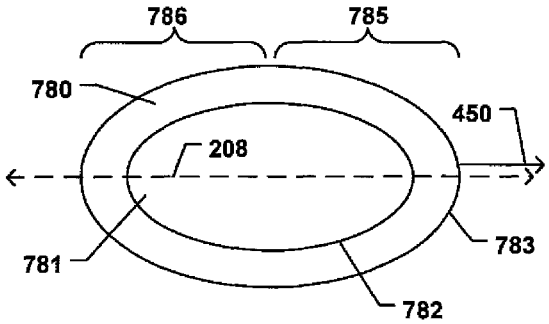

FIG. 7E includes an alternative shape for an abrasive segment according to embodiments herein, and in particular, may be considered a variation of the abrasive segment of FIG. 7D. As illustrated the abrasive segment 780 can have a rounded shape, and more particularly an elliptical shape. The abrasive segment 780 can have an outer surface 783 defining the general rounded contour of the article. The abrasive segment can have a central opening 781 defined by an inner surface 782. In particular, the outer surface 783 can act as a leading edge for the front portion 785 of the abrasive segment 780 assuming a direction of rotation along the directional vector 450. The same outer surface 783 can be a trailing edge at a rear portion 786 of the abrasive segment 780. More particularly, the inner surface 782 can act as a trailing edge within the front portion 785 and a leading edge within the rear portion 786 during use of the abrasive segment 780 along the directional vector 780. Like other embodiments herein, a significant portion of the abrasive segment 780 is comprised of leading edges and trailing edges, while the length of neutral edges is limited.

EXAMPLE

Sample segments were formed by initially forming a mixture of dry powders of copper, tin, graphite, and diamond grit. The mixture of copper and tin was approximately 50/50 by weight, which in turn was mixed with graphite at 20 volume percent. The diamond grit was sieved at U.S. mesh sizes 270/325 and was added to the mixture at 25 volume percent. The mixture was formed via a hot pressing mold having the shape of the final-formed article at a temperature of approximately 400° C.

After forming the segments, each segment is affixed to an aluminum base in predetermined positions identified by cavities machined into the aluminum base, which are spaced apart from each other through a circumference on the base. The segments are affixed to the base via epoxy cement. The formed abrasive wheel comprising the abrasive segments on the base is balanced and speed tested.

Figure 8:
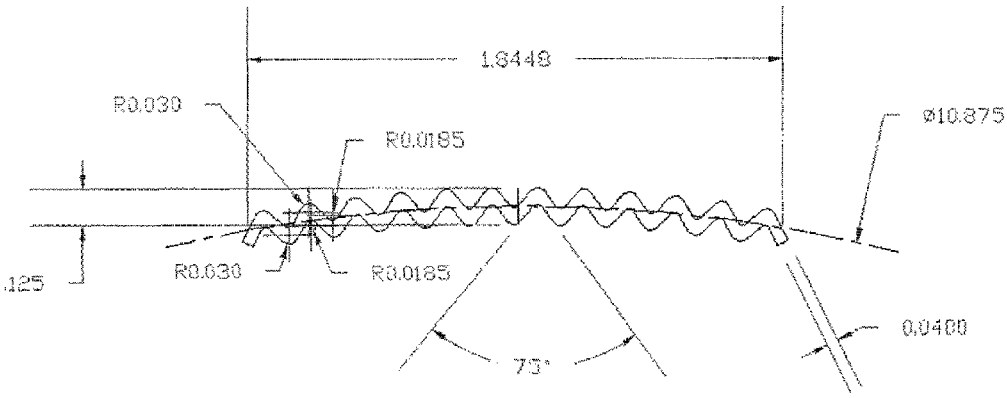
FIG. 8 includes an illustration of an abrasive article according to an embodiment.

Testing included grinding workpieces of c-plane sapphire wafers having a diameter of 75 mm, under condition of 0.8 microns/sec downfeed on a 250 mm diameter wheel. A first test was conducted using a grinding wheel having abrasive segments formed according to embodiments herein (Sample S1). Notably, the abrasive segments had a shape as illustrated in FIG. 8 (measurements given in inches), with a length along the null axis of 47 mm, cord length of approximately 45.7 mm, a cutting distance of 1.0 mm along the arc sector of the null axis between a leading edge and a trailing edge, and a joining angle of approximately 75 degrees. The abrasive segment sample had an edge ratio of 0.95.

Figure 9:
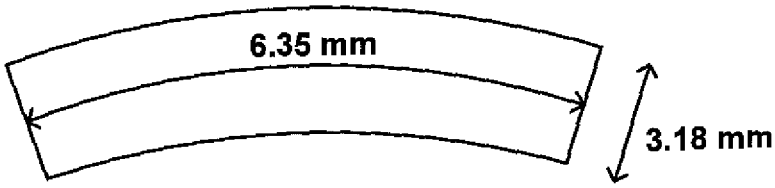
FIG. 9 (PRIOR ART)
FIG. 9 includes an illustration of a conventional abrasive article.

A conventional sample (CS1) having a conventional shape of an abrasive segment as illustrated in FIG. 9 was also tested for comparison of performance against Sample S1. As illustrated, the Sample CS1 has a generally arcuate shape having a length along the outer edge of approximately 6.35 mm, and straight ends having lengths of about 3.18 mm. The sample was measured to have an edge ratio of 0.33.

During testing, Sample S1 exhibited grinding forces that were stable with time, indicating sufficient and sharp cutting action for the entire duration of use. By contrast, the Sample CS1 demonstrated almost double the grinding forces initially, and the forces increased monotonically with time until the machine limit was reached, indicating substantial filling of the abrasive segment with swarf and inefficient cutting.

Figure 10:
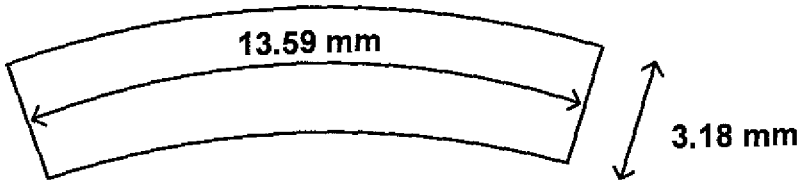
FIG. 10 (PRIOR ART)
FIG. 10 includes an illustration of a conventional abrasive article.

A third conventional sample (CS2) having a conventional shape of an abrasive segment as illustrated in FIG. 10 was also tested for comparison of performance against Sample S1. As illustrated, the Sample CS2 has a generally arcuate shape having a length along the outer edge of approximately 13.59 mm, and straight ends having lengths of about 3.18 mm. The sample was measured to have an edge ratio of 0.19.

The Sample CS2 was used under the same grinding conditions as provided above, with the exception that the workpiece was formed of a nickel-cobalt filled epoxy composite. Due to the high ductility of the composite, the wheel with edge ratio of 0.19 loaded up very quickly leading to high grinding forces. By comparison, Sample S1 demonstrated relatively stable grinding forces throughout the duration of use, thereby exhibiting improved grinding capabilities over the conventional Sample CS2.

The embodiments herein are directed to abrasive articles for use with grinding wheels that represent a departure from the state-of-the-art bonded abrasive articles. Notably, the embodiments herein utilize a combination of material components, design structures, and derived ratios present within an abrasive segment that facilitate improved grinding. Particular features of the embodiments that can be combined in various manners include abrasive grain sizes, bond materials, percentages of porosity with the abrasive body, shape of the twisted path, joining angles, edge ratios, cutting distance, volume of cavities, placement of cavities, designs of leading edges, trailing edges, and neutral edges. The foregoing describes a combination of features, which can be combined in various manners to describe and define the bonded abrasive articles of the embodiments. The description is not intended to set forth a hierarchy of features, but different features that can be combined in one or more manners to define the invention.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive article comprising:

an abrasive body comprising abrasive grains contained within a bond material, wherein the abrasive body comprises:

a plurality of leading edges spaced apart from each other along a null axis of the abrasive body, wherein a leading edge is defined by a series of leading points, each of the leading points having an outward normal vector having a positive vector component with regard to a directional vector defining a direction of rotation at the leading point;

a plurality of trailing edges spaced apart from each other along the null axis of the abrasive body, wherein a trailing edge is defined by a series of trailing points, each of the trailing points having an outward normal vector having a negative vector component with regard to a directional vector defining a direction of rotation at the trailing point;

a plurality of neutral edges, wherein a neutral edge is defined by a series of neutral points, each of the neutral points having an outward neutral normal vector perpendicular to the directional vector at that neutral point; and wherein the abrasive body comprises an edge ratio of between about 0.7 an about 0.98, wherein the edge ratio is defined by the equation [(Lle+Lte)/(Lle+Lte+Lne)], wherein Lle is the total length of the plurality of leading edges, Lte is the total length of the plurality of trailing edges, and Lne is the total length of the plurality of neutral edges.

2. The abrasive article of claim 1, wherein each of the leading edges of the plurality of leading edges intersects the null axis.

3. The abrasive article of claim 1, further comprising a plurality of cavities spaced along the null axis, each cavity of the plurality of cavities being spaced between one of the plurality of leading edges and one of the plurality of trailing edges.

4. The abrasive article of claim 3, further comprising a filler material filling the plurality of cavities.

5. The abrasive article of claim 4, wherein the filler material comprises an upper surface recessed from an upper surface of the abrasive body.

6. The abrasive article of claim 5, wherein the upper surface of the filler material is recessed from the upper surface of the abrasive body by a distance of not greater than about 95% of a height of the abrasive body.

7. The abrasive article of claim 5, wherein the upper surface of the filler material is recessed from the upper surface of the abrasive body by a distance of not greater than about 50% of a height of the abrasive body.

8. The abrasive article of claim 5, wherein the upper surface of the filler material is recessed from the upper surface of the abrasive body by a distance of not greater than about 20% of a height of the abrasive body.

9. The abrasive article of claim 4, wherein the filler material fills a majority of a volume of each cavity of the plurality of cavities.

10. The abrasive article of claim 4, wherein the filler material comprises a material selected from the group of materials consisting of inorganic materials, organic materials, and a combination thereof.

11. The abrasive article of claim 4, wherein the filler material comprises an organic material.

12. The abrasive article of claim 4, wherein the filler material comprises an elastomer.

13. An abrasive article comprising:

an abrasive segment including an abrasive body having a plurality of arm portions including abrasive grains contained within a bond material, the abrasive segment further comprising cavities disposed between each of the arm portions of the plurality of arm portions; and wherein each arm portion of the plurality of arm portions comprises a leading edge, a neutral edge and a trailing edge, wherein the leading edge is defined by a series of leading points, each of the leading points having an outward normal vector having a positive vector component with regard to a directional vector defining a direction of rotation at the leading point, wherein the neutral edge is defined by a series of neutral points, each of the neutral points having an outward neutral normal vector perpendicular to the directional vector at that neutral point and wherein the trailing edge is defined by a series of trailing points, each of the trailing points having an outward normal vector having a negative vector component with regard to the directional vector at the trailing point, wherein the abrasive body comprises an edge ratio of between about 0.7 an about 0.98, wherein the edge ratio is defined by the equation [(Lle+Lte)/(Lle+Lte+Lne)], wherein Lle is the total length of the plurality of leading edges, Lte is the total length of the plurality of trailing edges, and Lne is the total length of the plurality of neutral edges, and further wherein each arm portion has a cutting distance measured along an arc sector defining the direction of rotation between a leading point on the leading edge and a trailing point on the trailing edge, wherein the cutting distance is not greater than about 1000 Gs for a Gs between about 1 micron and about 500 microns, wherein Gs is the average grit size of the abrasive grains.

14. The abrasive article of claim 13, wherein the cutting distance is within a range between about 50 Gs and about 1000 Gs for a Gs between about 1 micron and about 5 microns.

* * * * *